United States Patent [19]

Sinnott

[11] 4,040,622

[45] Aug. 9, 1977

[54] WATER GUN GAME

[75] Inventor: Vernon J. Sinnott, Calgary, Canada

[73] Assignee: The Raymond Lee Organization, Inc., New York, N.Y. ; a part interest

[21] Appl. No.: 718,863

[22] Filed: Aug. 30, 1976

[51] Int. Cl.[2] ..... A63F 9/14

[52] U.S. Cl. ..... 273/86 R; 273/101; 273/102.1 E

[58] Field of Search ..... 273/86 R, 101, 102.1 C, 273/102.1 E, 119 B

[56] References Cited

U.S. PATENT DOCUMENTS

| | | | |
|---|---|---|---|
| 2,759,731 | 8/1956 | Quinn | 273/101 |
| 2,869,874 | 1/1959 | Berdner | 273/119 B |
| 3,342,492 | 9/1967 | Barrett | 273/86 R X |
| 3,362,713 | 1/1968 | Miller | 273/86 R X |

*Primary Examiner*—Anton O. Oechsle
*Attorney, Agent, or Firm*—Daniel Jay Tick

[57] ABSTRACT

A pan-type game board has a plurality of spaced water tanks thereon. Each water tank has an opening therethrough for admitting water thereinto. A figurine is pivotally mounted atop the tank in a manner whereby the figurine is in one of an upright visible position above the tank and a horizontal non-visible position at the top of the tank. A float device is pivotally mounted in the tank beneath a predetermined level in such manner that the float device is in upright position and non-buoyant and when water in the tank exceeds the predetermined level the float device is buoyed by the water to a horizontal position. A coupling couples the figurine to the float device whereby when the float device is buoyed to a horizontal position it pivotally moves the figurine to its horizontal position. A plurality of spaced water guns are provided on the game board. Each gun is adjustably mounted in a manner whereby it is directable to a corresponding one of the water tanks so that water may be directed from each of the guns into a corresponding one of the tanks via the opening thereof.

3 Claims, 3 Drawing Figures

WATER GUN GAME

BACKGROUND OF THE INVENTION

The present invention relates to a toy game. Objects of the invention are to provide a toy game of simple structure, which is inexpensive in manufacture, played without difficulty and provides considerable amusement for players and onlookers, and especially children.

BRIEF DESCRIPTION OF THE DRAWINGS

In order that the invention may be readily carried into effect, it will now be decribed with reference to the accompanying drawings, wherein.

DETAILED DESCRIPTION OF THE INVENTION

Figure 1:
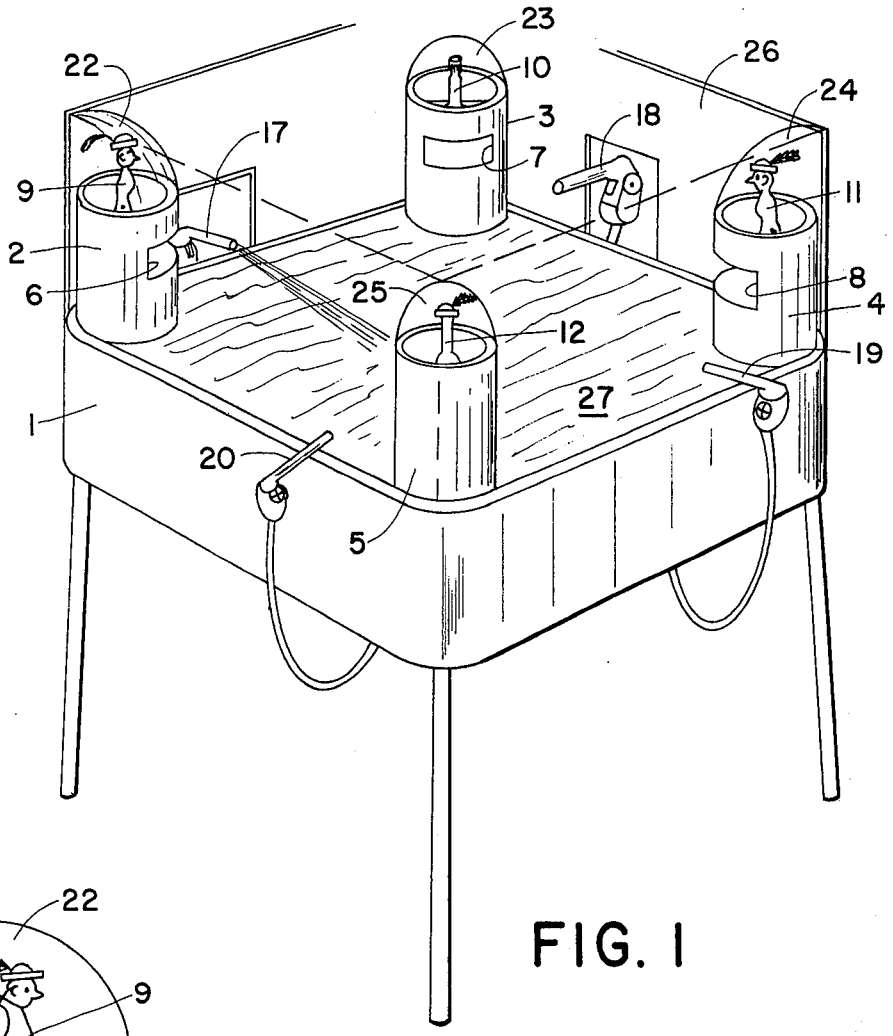
FIG. 1 is a perspective view of an embodiment of the toy game of the invention.
Figure 3:
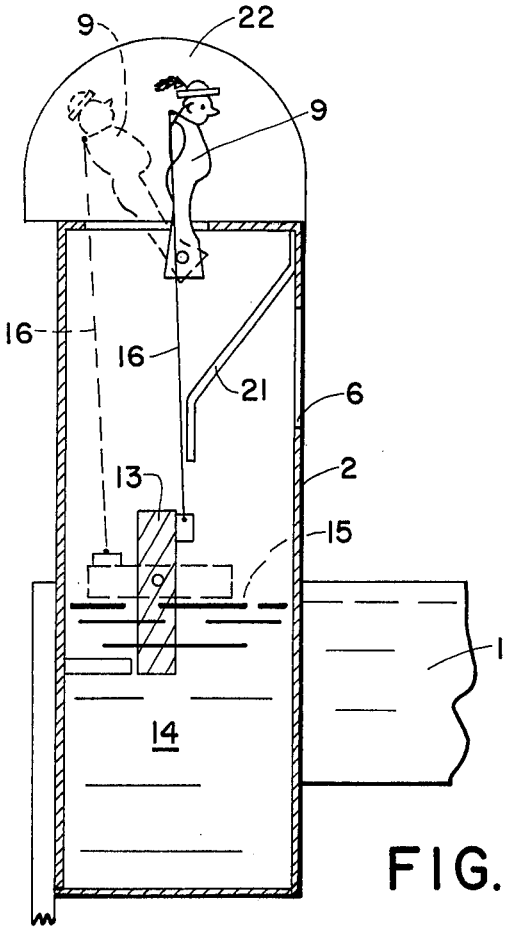
FIG. 3 is a view, partly in section, on an enlarged scale, of an embodiment of a water tank of the toy game of the invention.

The toy game of the invention comprises a pan-type game board 1 having a plurality of spaced water tanks 2, 3, 4 and 5 thereon (FIG.1). As shown in FIG. 3, for the tank 2, each water tank has an opening 6 therethrough for admitting water thereinto. As shown in FIG. 1, the water tanks 3 and 4 have openings 7 and 8, respecitvely, for admitting water thereinto. A figurine 9, 10 11 and 12, respectively, is pivotally mounted atop the tank 2, 3, 4 and 5, respectively, in a manner whereby the figurine is in one of an upright visible position, shown by solid lines in FIGS. 1 and 3 above the tank, and a substantially horizontal non-visible position, shown by broken lines in FIG. 3, at the top of the tank.

As shown in FIG. 3, each water tank has a float device 13 pivotally mounted in the tank in a manner whereby when water 14 in the tank is beneath a predetermined level 15, the float device is in upright position and non-buoyant, as shown by solid lines in FIG. 3 When the water 14 in the tank exceeds the predetermined level 15, the float device 13 is buoyed by the water to a substantially horizontal position, indicated by broken lines FIG. 3.

As shown in FIG. 3, each of the water tanks 2 to 5 has a coupling 16 which couples the figurine 9 to the float device 13. The coupling is connected to the float device 13 and to the figurine 9 in a manner whereby when the float device is buoyed to a substantially horizontal position, shown by broken lines in FIG. 3, it pivotally moves the figurine to its substantially horizontal position, shown by broken lines in FIG. 3.

A plurality of spaced water guns 17, 18, 19 and 20 (FIG. 1) are provided on the game board 1. Each of the water guns 17 to 20 is adjustably mounted in any suitable manner in a manner whereby it is directable to a corresponding one of the water tanks 2 to 15 so that water may be directed from each of said tanks 2 to 5 so that water may be directed from each of said guns into a corresponding one of said tanks via the opening thereof. Thus, for example, a player operating the gun 17 attempts to shoot water through the opening of the water tank 5. A player operating the gun 18 attempts to shoot water through the opening 6 of the water tank 2. A player operating the gun 19 attempts to shoot water through the opening 7 of the water tank 3. A player operating the water gun 20 attempts to shoot water through the opening 8 of the water tank 4.

When a player is successful in shooting enough water into the corresponding water tank to raise the water level to its predetermined point 15 (FIG. 3), the figurine 9 is pulled over into its horizontal position and is lost from sight to the players due to the buoyancy imparted to the float device 13 via the water in the tank.

As shown in FIG. 3, each of the water tanks 2 to 5 has a water shield 21 placed a distance behind the opening thereof to prevent water from soaking the coupling 16. Furthermore, each of the water tanks 2 to 5 has a transparent, clear plastic dome 22, 23, 24 and 25, respectively, covering said tank to prevent water from entering the tank through the top and to protect the figurine from being soaked.

The game board 1 comprises a shallow tank for collecting water failing to enter the water tanks 2 to 5 and a transparent shield 26 (FIG. 1) around the game board for preventing water from the water guns 17 to 20 from wetting an area around the game board.

Figure 2:
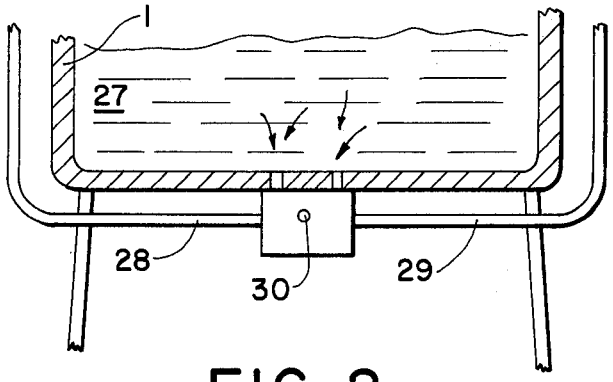
FIG. 2 is a view, partly in section, of part of the game board of the invention.

FIG. 2 illustrates a method of supplying water 27 to the water guns 17 to 20 from the shallow tank game board 1. As shown in FIG. 2, the water 27 is supplied through a series of conduits 28, 29, 30 and 31 (not shown in the FIGS.) to the water guns 17 to 20.

While the invention has been described by means of a specific example and in a specific embodiment, I do not wish to be limited thereto, for obvious modifications will occur to those skilled in the art without departing from the spirit and scope of the invention.

I claim:

1. A toy game, comprising a pan-type game board having a plurality of spaced water tanks thereon, each water tank having an opening therethrough for admitting water thereinto, figurine pivotally mounted atop the tank in a manner whereby the figurine is in one of an upright visible position above the tank and a substantially horizontal non-visible position at the top of the tank, float means pivotally mounted in the tank in a manner whereby when water in the tank is beneath a predetermined level, the float means is in upright position and non-buoyant and when water in the tank exceeds the predetermined level, the float means is buoyed by the water to a substantially horizontal position and coupling means for coupling the figurine to the float means whereby when the float means is buoyed to a substantially horizontal position it pivotally moves the figurine to its substantially horizontal position; and a plurality of spaced water guns on the game board each adjustably mounted in a manner whereby it is directable to a corresponding one of the water tanks so that water may be directed from each of said guns into a corresponding one of the tanks via the opening thereof.

2. A toy game as claimed in claim 1, further comprising a pluarality of transparent domes each covering a corresponding one of the water tanks to prevent water from entering the tank through the top.

3. A toy game as claimed in claim 1, wherein the game board comprises a shallow tank for collecting water failing to enter the water tanks and shielding means around the game board for preventing water from the water guns from wetting an area around the game board.

* * * * *